US009850052B2

(12) United States Patent
Yagi et al.

(10) Patent No.: US 9,850,052 B2
(45) Date of Patent: Dec. 26, 2017

(54) PRESS-THROUGH PACK PACKAGE

(75) Inventors: Masahiro Yagi, Tokyo (JP); Hiroaki Kimura, Tokyo (JP); Yutaka Matsuki, Tokyo (JP); Hideki Hayashi, Tokyo (JP)

(73) Assignee: ASAHI KASEI CHEMICALS CORPORATION, Tokyo (JP)

( * ) Notice: Subject to any disclaimer, the term of this patent is extended or adjusted under 35 U.S.C. 154(b) by 0 days.

(21) Appl. No.: 13/302,157

(22) Filed: Nov. 22, 2011

(65) Prior Publication Data

US 2012/0125806 A1 May 24, 2012

(51) Int. Cl.

| | |
|---|---|
| ***B65D 75/28*** | (2006.01) |
| ***B65D 75/34*** | (2006.01) |
| ***B65D 35/38*** | (2006.01) |
| ***B65D 75/32*** | (2006.01) |

(52) U.S. Cl.

CPC ..... *B65D 75/327* (2013.01)

(58) Field of Classification Search

CPC ..... B65D 65/38; B65D 75/327
USPC ..... 428/212, 213, 36.6, 220, 35.7; 3/212, 3/213, 36.6, 220, 35.7
See application file for complete search history.

(56) References Cited

U.S. PATENT DOCUMENTS

| | | | | |
|---|---|---|---|---|
| 5,522,506 | A * | 6/1996 | Roulin et al. | 206/531 |
| 6,265,041 | B1 * | 7/2001 | Maeda | B65D 65/38 206/531 |
| 2008/0193783 | A1 * | 8/2008 | Imai et al. | 428/480 |

FOREIGN PATENT DOCUMENTS

| | | | |
|---|---|---|---|
| CN | 1234006 | | 11/1999 |
| CN | 101508370 | | 8/2009 |
| EP | 0656389 | * | 6/1995 |
| JP | 54-11258 | | 5/1979 |
| JP | H0255122 | | 2/1990 |
| JP | H04-236240 | | 8/1992 |
| JP | 6-39015 | | 2/1994 |
| JP | 9-052313 | | 2/1997 |
| JP | 9-57920 | | 3/1997 |
| JP | 09058744 | * | 3/1997 |
| JP | 10-101132 | | 4/1998 |
| JP | 10-101133 | | 4/1998 |
| JP | H11227851 | | 8/1999 |
| JP | 2004-331715 | | 11/2004 |
| JP | 2005047601 | * | 2/2005 |
| JP | 2005324834 | | 11/2005 |
| JP | 2005-329617 | | 12/2005 |
| JP | 2005330299 | * | 12/2005 |
| JP | 2004-256125 | | 4/2007 |
| JP | 3906485 | | 4/2007 |
| JP | 2008150623 | | 7/2008 |

OTHER PUBLICATIONS

Japanese Office Action in related application No. JP2009-115511, dated May 7, 2013.

(Continued)

*Primary Examiner* — Ellen S Wood
(74) *Attorney, Agent, or Firm* — Greenblum & Bernstein, P.L.C.

(57) ABSTRACT

The press-through pack package of the invention has a covering material composed of a stretched film with at least one layer comprising a thermoplastic resin and an inorganic filler at 5 parts by weight with respect to 100 parts by weight of the thermoplastic resin.

9 Claims, 3 Drawing Sheets

(56) References Cited

OTHER PUBLICATIONS

Chinese Office Action in counterpart application No. 201180053792.3, dated Mar. 3, 2014.
International Preliminary Report on Patentability in related application No. PCT/JP2011/075857, dated Jun. 20, 2013.
Japanese Office Action in counterpart application No. JP2009-115511, dated May 27, 2014.
Japanese Office Action in counterpart application No. JP2009-115511, dated Jan. 7, 2014.

* cited by examiner

PRESS-THROUGH PACK PACKAGE

BACKGROUND OF THE INVENTION

Field of the Invention

The present invention relates to a press-through pack package comprising a covering material film, that can be suitably used primarily for packaging of pharmaceuticals such as tablets or capsules, or foods such as candy or chocolate.

Related Background Art

One known form for packaging of pharmaceuticals and foods is a press-through pack (hereunder, "PTP") package that comprises a base material and a covering material. PTP packages are formed by preparing a base material molded to have a pocket-shaped recess by vacuum forming or pressure forming of a plastic sheet made of a polyvinyl chloride-based resin or polypropylene-based resin, packing contents into the recess, and then sealing flange sections that are separate from the recess, with a heat sealable covering material.

A PTP package has a construction such that force is applied to the housed contents from the outer side of the base material in the direction of the covering material to tear the covering material, and remove the contents. Therefore, the covering material of the PTP package must have a property of easily tearing when the contents are pushed out (a press-through property). Aluminum foil is currently in wide use as a covering material because of its excellent press-through property.

However, PTP packages employing aluminum foil covering materials are associated with the following problems. Specifically, when the package is discarded after removing the contents, the aluminum foil covering material is preferably separated from the plastic base material from the viewpoint of recent recycling use of resources, but this requires considerable effort and is physically difficult to accomplish. With thermal disposal as well, the large heat value of aluminum foil results in damage to incinerators and melted integration, thereby lowering the incineration efficiency. In addition, production of aluminum requires a large amount of electrical energy, and is associated with problems of cost as well as environmental pollution including $CO_2$ waste. At locations of PTP packaging, almost all detachment of packagers for aluminum foil covering material rolls is carried out by hand, and this increases the burden on workers by handling of heavy items and increases the risk of injury by dropping.

In light of this condition, there have been proposed various types of plastic covering material films as PTP covering materials that do not use aluminum foil (see Patent documents 1-4).

Patent Document 1 describes a PTP covering material sheet comprising 5-250 parts by weight of an inorganic filler with respect to 100 parts by weight of a resin such as a polyolefin, polyester, polyvinyl chloride, polystyrene or styrene copolymer, in order to lower the rupture strength of the resin film and exhibit a satisfactory press-through property.

Patent Document 2 describes a PTP covering material having a resin film layer formed on one side of a polypropylene-based sheet comprising inorganic powder.

Patent Document 3 describes a PTP covering material film having a press-through property by providing innumerable scratch marks on a plastic film surface that do not penetrate, and a PTP covering material film having a protective layer formed by resin coating to protect the scratch marks, as well as a PTP employing the same.

Patent Document 4 describes a film comprising a uniaxially stretched common resin such as ordinary polystyrene, and a PIP package in which the uniaxial stretching direction and the long axis direction of the opening are aligned.

CITATION LIST

[Patent document 1] Japanese Unexamined Patent Application Publication HEI No. 10-101133

[Patent document 2] Japanese Unexamined Patent Application Publication HEI No. 09-57920

[Patent document 3] Japanese Unexamined Patent Application Publication HEI No. 06-39015

[Patent document 4] Japanese Examined Utility Model Application Publication SHO No. 54-11258

SUMMARY OF THE INVENTION

Incidentally, the requirements for printing on pharmaceutical PTP packages have increased in recent years, for printing of various types of information such as conventional designs that indicate product name logos or methods of use, as well as product codes aimed at preventing medical mishaps or ensuring traceability, expiration dates, serial numbers, quantities and the like, or printing of barcodes containing such information. Because pharmaceutical PTP packages are generally small, and their information must be printed in limited narrow spaces on covering material films, there is a demand for increased amounts of printed information and greater printed readability.

The PTP covering material sheet described in Patent document 1 contains a large amount of inorganic filler in the resin, and therefore the surface is rough, resulting in blurred printing when it is attempted to print on the covering material sheet. When the printing on a covering material sheet is blurred, the printed information is difficult to read or it may be misread. Furthermore, the large amount of added inorganic filler introduces a constant potential of shedding of the filler from the covering material sheet, and a risk of contamination of the pharmaceutical or food contents.

The sheet described in Patent document 2 is designed for improved printing clarity by provision of a resin film on the surface of a polypropylene-based sheet containing inorganic powder. However, lamination of a resin film layer tends to increase the covering material strength and lower the press-through property. When the resin film layer is reduced in thickness to minimize this problem, reduction in the surface roughness becomes insufficient, making it impossible to adequately improve the print readability. It has therefore been difficult to achieve both a press-through property and printing suitability. Moreover, the need for lamination of a resin film layer increases production cost.

The film described in Patent document 3 has a laminated protective layer to prevent pinholes caused by the scratch marks that are provided to impart a press-through property, and the press-through property is inadequate due to the thickness of the protective layer, as with Patent document 2. It also has room for improvement, due to its insufficient print readability resulting from the rough surface of the scratch marks, and high production cost.

On the one hand, a PTP covering material film must have an excellent press-through property from the viewpoint of ease of removal of the contents, but on the other hand it must also have strength capable of withstanding the various loads to which it is subjected in the PTP package production process. Specifically, a PTP covering material film is subjected to a large number of processing steps up to sealing to the base material, including the film formation step, slit step, printing step, sealing agent coating step and the step of sealing onto the base material, and it must have sufficient tensile strength to withstand the loads such as tensile force to be undergone during the processing steps. While the films described in Patent documents 1-3 exhibit a press-through property by addition of an inorganic filler or inorganic powder or provision of scratch marks for easier tearing, their tensile strength is also reduced, and therefore troubles tend to occur during the processing steps, such as tearing of the film.

The film described in Patent document 4 is a film having a resin such as ordinary polystyrene stretched in the uniaxial direction, but no special modification is provided to impart a press-through property, and the press-through property is inferior.

The present invention has been accomplished in light of these circumstances, and its object is to provide a PTP package that has a plastic covering material film which is extremely light compared to conventional aluminum foil covering materials, and that can be easily disposed of after use, while also avoiding contamination of contents and exhibiting an excellent press-through property and print readability, and which exhibits excellent processing suitability, tablet removal sound and heat sealing stability.

As a result of much diligent research directed toward solving the problems mentioned above, the present inventors have found that the problems can be solved if the PTP covering material used is a film comprising a stretched thermoplastic resin containing a small amount of or no inorganic particles, and the invention has thereupon been completed.

Specifically, the present invention provides the following PTP packages. .

(1) A press-through pack package with a covering material composed of a stretched film with at least one layer comprising a thermoplastic resin and an inorganic filler at 5 parts by weight with respect to 100 parts by weight of the thermoplastic resin.

(2) A press-through pack package according to (1), wherein the stretched film has a value of 0.2-5.4 MPa for the peak value of the orientation release stress, measured at a temperature 20° C. higher than the Vicat softening temperature of the thermoplastic resin, in either or both the MD and TD of the film.

(3) A press-through pack package according to (1) or (2), wherein the stretched film has a value of 0.2-5.4 MPa for the peak value of the orientation release stress, measured at a temperature 20° C. higher than the Vicat softening temperature of the thermoplastic resin, in both the MD and TD of the film.

(4) A press-through pack package according to any one of (1) to (3), wherein the mean particle size of the inorganic filler is 1-10 μm.

(5) A press-through pack package according to any one of (1) to (4), wherein the thermoplastic resin is a styrene-based resin.

(6) A press-through pack package according to any one of (1) to (5), wherein the inorganic filler is an amorphous aluminosilicate.

(7) A press-through pack package according to any one of (1) to (6), wherein the thermoplastic resin is a thermoplastic resin including at least one selected from the group consisting of styrene-acrylic acid copolymer resins, styrene-methacrylic acid copolymer resins, styrene-maleic anhydride copolymer resins and terpolymer resins comprising one of these 3 copolymer resins and an ester component.

(8) A press-through pack package according to any one of (1) to (7), wherein the stretched film has a piercing strength of 1-5N.

(9) A press-through pack package according to any one of (1) to (8), wherein the stretched film has a thickness of 5-30 μm.

(10) A press-through pack package according to any one of (1) to (9), wherein the stretched film has an aluminum vapor deposition layer laminated on at least one side.

The covering material used for the PTP package of the invention is composed of a plastic film having a low content of or containing no inorganic material, and hence there is virtually no risk of contamination of the contents by shedding of inorganic filler, and when it is used together with a plastic PTP base material, separation during disposal after use is facilitated, or even with thermal disposal, there are no concerns of incinerator damage, the incineration residue is low and the disposal is environmentally friendly. In addition, since the covering material has an excellent press-through property, its use allows production of a PTP with easily manageable contents. Furthermore, since the surface of the covering material can have low roughness, it is possible to produce clear printing with excellent readability.

In addition, the covering material has a "pop" removal sound that is produced when tablets (contents) are removed (this will hereunder be referred to as "tablet removal sound"), which is a clear, clean audible sound, and therefore the PTP package has advantages including easy confirmation of opening not only by visual and tactile means but also by auditory means, offering peace of mind that the package has been opened for the first time, differentiation of the package can be determined not only by design but also by auditory means, and it has not only the function of a simple package but also allows the opening itself to be enjoyable, and can also have an effect of preventing senile dementia as well.

Moreover, during heat sealing with the base material, the covering material is capable of stable heat sealing that does not produce deformation such as wrinkles in the covering material film, and an aesthetic package can be obtained.

DESCRIPTION OF THE PREFERRED EMBODIMENTS

Preferred embodiments of the invention will now be explained in detail, with reference to the accompanying drawings. The package of the invention is for packing of contents that are pharmaceuticals such as tablets or capsules or foods such as candy or chocolate, but the following examples assume packing of tablets. However, the invention is not limited to the examples described below.

Figure 1:
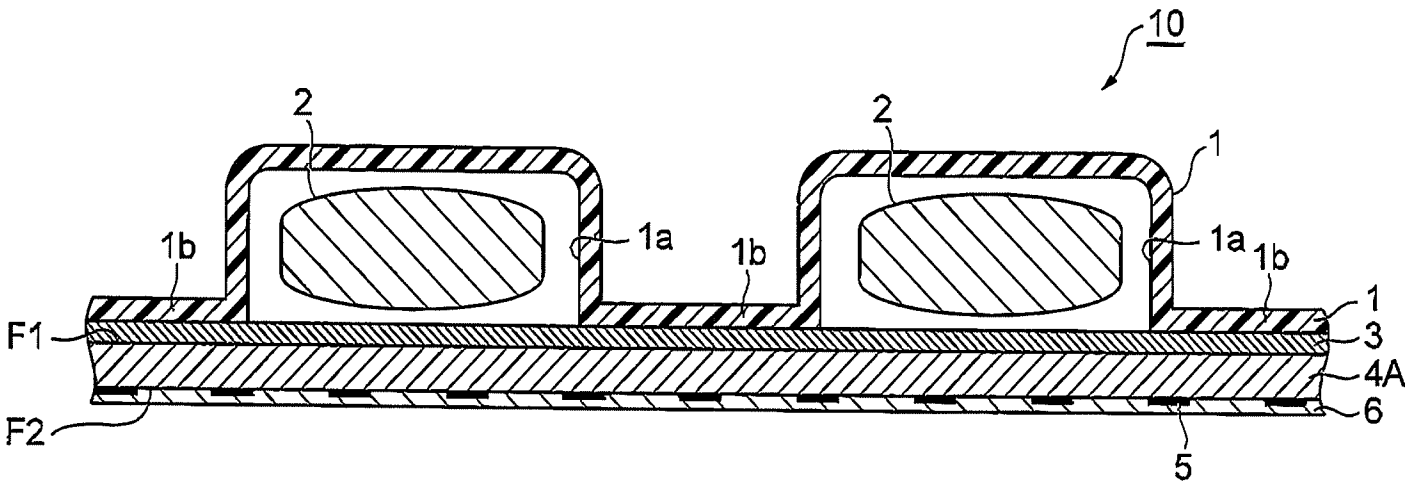
FIG. 1 is a cross-sectional view showing an embodiment of a PTP package of the invention comprising a covering material film.

The PTP package 10 shown in FIG. 1 comprises a base material 1 and a covering material film 4A, and tablets 2 are packed into pocket-shaped recesses 1*a* formed in the base material 1. A seal layer 3 composed of a heat sealing agent is formed between the base material 1 and the covering material film 4A, and the seal layer 3 bonds the flange section 1*b* of the base material 1 with the surface F1 of the covering material film 4A. A printed section 5 such as a product name logo is formed on the surface F2 on the side of the covering material film 4A opposite the base material 1 side, and an OP (Over Print) varnish layer 6 is formed covering the entire surface F2 to protect the printed section 5.

The covering material film 4A is composed of a stretched film comprising a thermoplastic resin. The thermoplastic resin is not particularly restricted so long as it can be formed into a film, and it may be an olefin-based resin such as a styrene-based resin, ethylene-based resin or propylene-based resin, an ester-based resin (including polylactic acid) or an amide-based resin. Any one of these solvents may be used alone, or two or more thereof may be used in admixture. Preferably styrene-based resins are preferred among thermoplastic resins from the viewpoint of rigidity and brittleness.

A styrene-based resin to be suitably used for this embodiment is a homopolymer or copolymer of a styrene-based monomer, or a mixed composition thereof, the styrene-based monomer being styrene (GPPS) or an alkylstyrene such as α-methylstyrene. A copolymer is a styrene-(meth)acrylic acid copolymer, styrene-(meth)acrylic acid ester copolymer, styrene-acid anhydride copolymer, styrene-butadiene copolymer, high impact polystyrene (HIPS) or the like, and it is a polymer with a styrene monomer content of at least 50 wt %.

Most preferred among these are thermoplastic resins including at least one selected from the group consisting of styrene-acrylic acid copolymer resins, styrene-methacrylic acid copolymer resins, styrene-maleic anhydride copolymer resins and terpolymer resins comprising one of these 3 copolymer resins and an ester component.

The ester component of the terpolymer resin may be methyl acrylate, ethyl acrylate, propyl acrylate, butyl acrylate, hexyl acrylate, cyclohexyl acrylate, methyl methacrylate, ethyl methacrylate, propyl methacrylate, butyl methacrylate, hexyl methacrylate, cyclohexyl methacrylate or the like. These ester components are effective for improving the thermostability of the resin when heat is to be continuously applied during the melting steps with an extruder, for example.

Each styrene component of the styrene-based copolymer resin is preferably present at 70-97 wt % and more preferably 75-95 wt % based on the total resin components composing the styrene-based copolymer resin. If the styrene component is no greater than 97 wt %, not only will the press-through property be improved, but the heat resistance of the resin will be increased and it will be possible to accomplish stable production during production of the PTP package, without deformation of the covering material film during heat sealing with the base material. If the styrene component is at least 70 wt %, it will be easy to accomplish stretching film formation when the covering material film is produced, and it will be possible to obtain both rigidity and a press-through property. Styrene-methacrylic acid copolymer resins and terpolymer resins comprising a styrene-methacrylic acid copolymer resin with an ester component are preferred for easier extrusion and stretching film formation, press-through property, printing clarity, and heat sealing stability during production of the PIP package. The term "styrene-based copolymer resin" means a copolymer resin having a styrene component of greater than 50 wt %, regardless of the number of types of copolymer resin components.

In the aforementioned terpolymer resin, the ester component content is preferably 2-20 wt % and more preferably 2-10 wt % based on the total ternary components including the other copolymer resin component. If the ester component content is no greater than 20 wt %, the balance between heat resistance and rigidity will be improved and it will be possible to stabilize the processing suitability during the PTP package production steps. Also, if the ester component content is 2 wt % or greater, the thermostability during melt working is improved and bleed-out of gel is prevented, and it is possible to accomplish stable extrusion/stretching film formation for prolonged periods.

In some cases it is necessary for a styrene-based resin suitable for use in this embodiment to have improved stability during stretching film formation (lack of necking, stable stretching start position, few thickness irregularities to avoid problems with practical use (normally R ≤20%)), and to have impact resistance against impacts suffered during reactivation after pausing or during punching in the packaging step, in the various subsequent steps up to PTP packaging. hi order to improve these properties, it is preferred to add at least one component selected from among high impact polystyrene (HIPS), styrene-conjugated diene copolymers and hydrogenated styrene-conjugated diene copolymers, at 0.5-80 wt %. The content is more preferably 1.0-45 wt %, even more preferably 1.0-30 wt %. A content of 0.5 wt % or greater will improve the stretching stability and impact resistance, while a content of no greater than 80 wt % will maintain the press-through property and film stiffness.

The resin composition used to form the covering material film 4A may comprise an inorganic filler in a thermoplastic resin. Although a satisfactory press-through property can be exhibited without adding an inorganic filler, the piercing strength may be reduced and the press-through property adjusted by the inorganic filler content, depending on the preference for use when the contents are to be pushed out, in consideration of the fact that PTP package users are not limited to healthy individuals but also include elderly and children with weak strength. The content of the inorganic filler is less than 5 parts by weight with respect to 100 parts by weight of the thermoplastic resin. An inorganic filler content of 5 parts by weight or greater will increase the roughness of the film surface and impair the printing clarity. From the viewpoint of the press-through property and risk of shedding, the inorganic filler content is preferably less than 3 parts by weight and more preferably no greater than 2 parts by weight with respect to 100 parts by weight of the thermoplastic resin.

The inorganic filler used may be amorphous aluminosilicate, silica, alumina, talc, kaolin, mica, wollastonite, clay, calcium carbonate, asbestos, glass fiber, aluminum sulfate or the like. An amorphous aluminosilicate is preferred for low hygroscopicity and to prevent thickness variation and foaming defects in the film caused by variation in pressure during film extrusion.

The mean particle size of the inorganic filler is preferably 1-10 μm and more preferably 3-7 μm. A mean particle size of no greater than 10 μm will reduce roughness of the film surface and allow clear film printing, while a mean particle size of at least 1 μm will facilitate adjustment of the press-through property with a small content. The "mean particle size" referred to here is the value measured by the Coulter counter method.

The covering material film 4A must be a stretched film. As mentioned above, the covering material film 4A is subjected to a strong tensile force on the film during the processing steps until it is provided for use, and it must therefore have tensile strength that can withstand this processing. Stretching orientation of the thermoplastic resin film will significantly improve the tensile strength in the stretching direction, but the improvement in the piercing strength tends to be relatively small. Consequently, even if the piercing strength is lowered by reduction of the thickness of the thermoplastic resin film or addition of an inorganic filler, with a stretched film it is possible to impart tensile strength able to withstand processing. That is, in a PTP covering material film employing a non-stretched film, it is necessary to add a large amount of inorganic filler or create marks in order to achieve piercing strength for a satisfactory press-through property, and therefore the tensile strength is reduced and the processing suitability is inadequate. When the film is reduced in thickness to improve this situation, the press-through property is impaired. However, with the stretched film of this embodiment, it is possible to obtain a thinner PTP covering material film having a satisfactory press-through property and tensile strength that can withstand processing.

A uniaxial stretching film is easily torn in the direction parallel to the stretching direction and tends to have a directional property to tearing of the film, and it is therefore necessary to consider the form of the contents and the stretching direction of the covering material film. For example, the contents will be more easily removable if the long side direction of the contents and the stretching direction of the covering material film are parallel. On the other hand, since a biaxial stretched film has a poor directional property for tearing, a biaxial stretched film is more preferably used for this embodiment.

The peak value for orientation release stress (hereunder also referred to as "ORS") at a temperature 20° C. higher than the Vicat softening temperature of the thermoplastic resin used in the film of this embodiment, in either or both the MD (Machine Direction) and TD (Transverse Direction) is preferably 0.2-5.4 MPa, and more preferably the values in both the MD and TD are 0.2-5.4 MPa, even more preferably 0.3-3.0 MPa and most preferably 0.3-2.0 MPa.

The orientation release stress (ORS) peak value is an index representing the strength of stretching orientation of the film, and it is a characteristic value determined by the draw ratio and temperature after film extrusion. Generally speaking, when the draw ratio has been increased (or decreased) under constant conditions of stretching temperature, the ORS tends to be higher (or lower) and the tensile strength in that direction tends to be higher (or lower), and when the stretching temperature has been raised (or lowered) under constant conditions of stretching temperature, the ORS tends to be lower (or higher) and the tensile strength in that direction tends to be lower (or higher). The preferred range for the ORS is set based on this characteristic, so that the required tensile strength film is obtained. If the ORS in each direction is 0.2 MPa or greater, troubles such as tearing or rupture during the PTP packaging steps are avoided and packaging can be accomplished at high speed, while if the ORS in each direction is no greater than 5.4 MPa, a satisfactory punching and cutting property is obtained after heat sealing with the base material during PTP packaging, generation of whiskers or loose filaments on cut edges can be inhibited, and the press-through property is also satisfactory.

The ratio of the ORS in the MD and TD is preferably 0.1-40, more preferably 0.2-15 and even more preferably 0.5-2, to avoid troubles such as tearing or rupture during the PTP packaging steps, and from the viewpoint of the press-through property and tablet removal sound.

The Vicat softening temperature mentioned above is the value measured according to JIS K7206. Test loading is 50 N, and a rate of temperature increase is 50° C./h. When a mixed resin comprising multiple thermoplastic resins is to be used in the film of this embodiment, this refers to the Vicat softening temperature of the mixed resin composition. Also, when the covering material film of this embodiment is a multilayer stretched film, the total thickness of only the resin layers comprising the thermoplastic resin to be used in the film of this embodiment are considered, and the Vicat softening temperature is the total sum of the values of each Vicat softening temperature multiplied by the thickness ratio of each layer, with 1 as the total thickness of only those layers.

The Vicat softening temperature of the resin composition of this embodiment is preferably 80° C. or higher, even more preferably 95° C. or higher and most preferably 110° C. or higher, from the viewpoint of allowing stable heat sealing without causing deformation such as wrinkling of the covering material film during heat sealing with the base material.

The PTP covering material film of this embodiment preferably has a piercing strength of 1-5N, as measured by the piercing strength test of JIS Z1707, If the piercing strength is at least 1N, the strength will be suitable and the covering material will rarely tear unintentionally during use of the PTP package. If the piercing strength is no greater than 5N, the film will be easily tearable and will exhibit an adequate press-through property. In consideration of cases where the user of the PTP package is an elderly person or child who has weak strength, the piercing strength is more preferably 1-3N.

The thickness of the film of this embodiment is preferably 5-30 μm. A thickness of 5 μm or greater will result in adequate film strength in the range of the stress relaxation peak value and will more easily exhibit tensile strength that can withstand the processing steps, while a thickness of no greater than 30 μm will more easily exhibit a suitable press-through property in the range of the aforementioned inorganic filler content.

A typical example of a method of producing a stretched film of this embodiment is a method in which a thermoplastic resin (a resin having an inorganic filler mixed at a prescribed proportion if necessary) is melt kneaded with a screw extruder or the like and formed into a sheet using a T-die, and then subjected to uniaxial stretching by roll stretching or tenter stretching, a method of biaxial stretching by tenter stretching followed by roll stretching, or a method of stretching by an inflation method. The draw ratio at this time is preferably 5-10 in each stretching direction.

For this embodiment, additives that are commonly used in the technical field, such as metal soaps to aid dispersion of the inorganic particles, coloring agents, plasticizers, antioxidants, heat stabilizers, ultraviolet absorbers, lubricants and antistatic agents, may be added within ranges that do not impair the properties of the invention.

The PTP package of this embodiment, having the construction described above, is much lighter than conventional aluminum foil covering materials and is easier to dispose of after use, while also having no contamination of contents and having an excellent press-through property and print readability.

In addition, since the package readily produces a "pop" sound (tablet removal sound) when the tablet is removed, its advantages include easy confirmation of opening not only by visual and tactile means, but also by auditory means.

Moreover, during heat sealing between the covering material and base material, the PIP package of this embodiment is capable of stable heat sealing that does not produce deformation such as wrinkles in the covering material film, and an aesthetic package can be obtained.

The embodiments described above are preferred embodiments of the invention, but the invention is not limited thereto. For example, a covering material film 4A composed of a monolayer stretched film was described for this embodiment, but the covering material film may instead consist of a multilayer stretched film with 2 or more layers.

Figure 2:
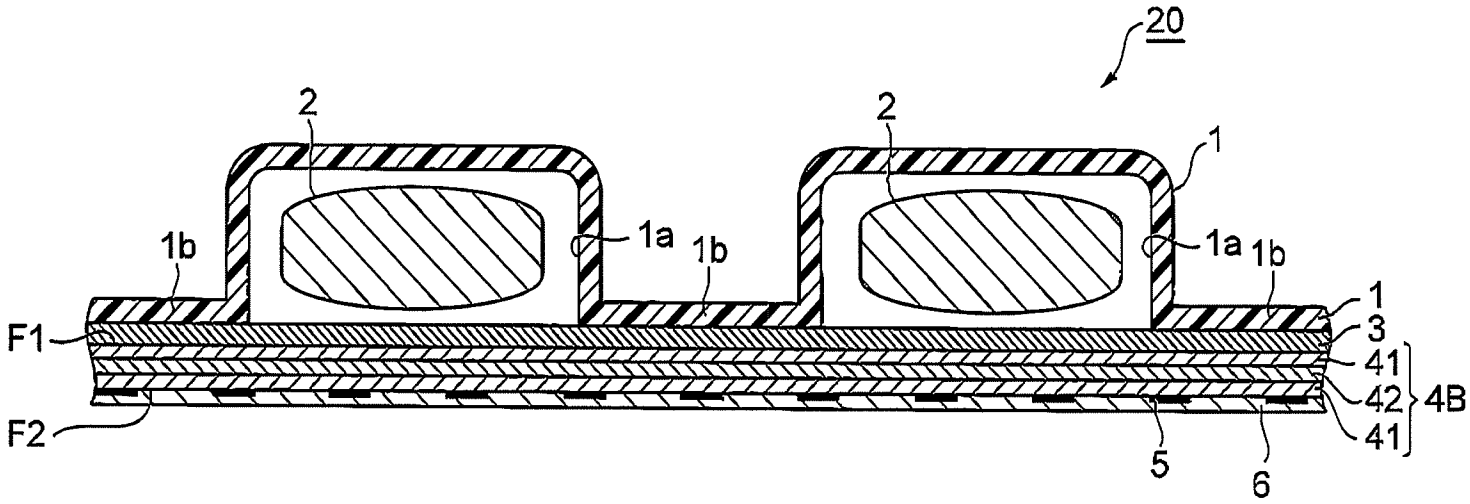
FIG. 2 is a cross-sectional view showing an embodiment of a PTP package of the invention comprising a multilayer covering material film.

The PTP package 20 shown in FIG. 2 differs from the PTP package 10 in that the covering material film 4B is a multilayer stretched film. The covering material film 4B is a three-layer film comprising a center layer 42 and surface layers 41 on both sides. The multilayer stretched film can be produced by the same method as the monolayer stretched film described above, by a T-die method or inflation method using an apparatus equipped with multiple screw extruders and a multilayer die.

For example, when it is desired to minimize the piercing strength while retaining film surface smoothness, the stretched film may have the following 3-layer structure: thermoplastic resin monolayer/inorganic filler-containing thermoplastic resin layer/thermoplastic resin monolayer. As an alternative layering order, a stretched film with a 3-layer structure: inorganic filler-containing thermoplastic resin layer/thermoplastic resin monolayer/inorganic filler-containing thermoplastic resin layer, may be used to impart a press-through property with the inorganic filler in the surface layer while retaining tensile strength in the center layer. Also, by using coloring resins with different colors to form a multilayer stretched film, it is possible to obtain a PTP covering material film with different colors on the front and back sides, for a design property. All of these may be applied within the range of the object of the invention.

Figure 3:
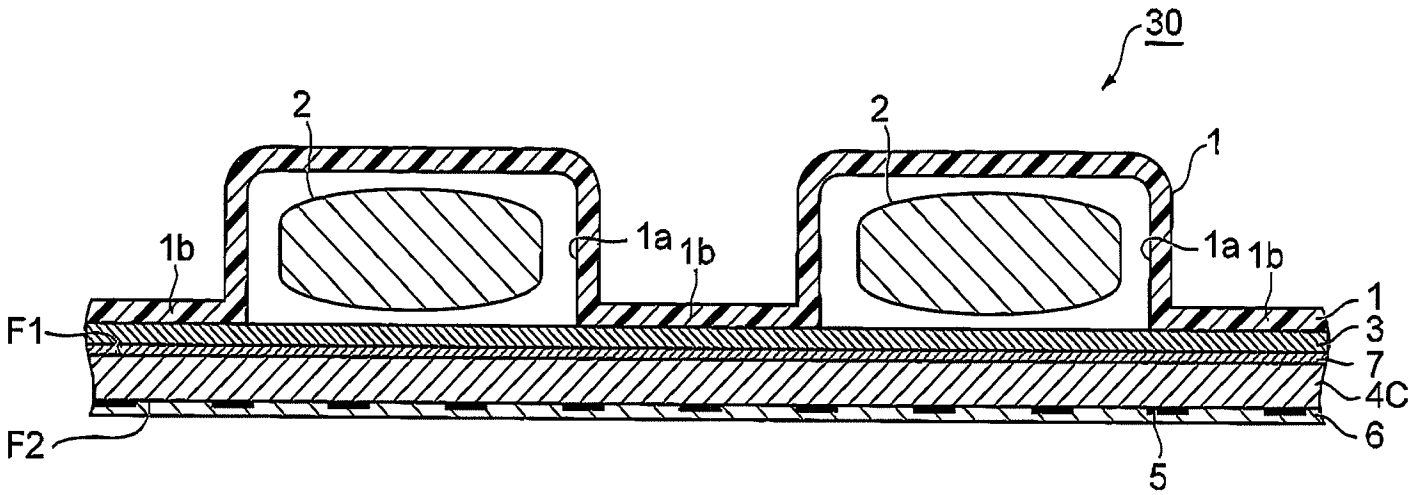
FIG. 3 is a cross-sectional view showing an embodiment of a PTP package of the invention comprising a vapor deposition layer-attached covering material film.

The embodiment described above assumes that the seal layer 3 is provided directly on the surface F1 of the covering material film 4A, but alternatively, another layer may be inserted between the covering material film and the seal layer. The PTP package 30 shown in FIG. 3 has a vapor deposition layer 7 and a seal layer 3 laminated in that order on the surface F1 of a covering material film 4C. The vapor deposition layer 7 and seal layer 3 may also be situated on the opposite surfaces of the covering material film 4C. For printing onto the covering material film, and also lamination of the seal layer and vapor deposition layer, it is preferred to subject the covering material film surface to a known method of surface treatment beforehand, such as corona treatment, plasma treatment, flame treatment, solvent treatment or the like.

When the contents of the PTP covering material film are hygroscopic, a barrier property will be necessary to inhibit permeation of water vapor. In this case, a vapor deposition layer with a barrier property (barrier layer) is preferably laminated on the surface of the covering material film. Materials for the barrier layer include aluminum and metal oxides (aluminum oxide, silicon oxide and the like).

In recent years, in the field of pharmaceutical PTP packages, a method is often adopted in which the PTP package is irradiated with near infrared rays after packaging of the contents, and reflection by the aluminum foil covering material is utilized to examine any contaminants. Since this requires an aluminum layer to reflect the near infrared rays, an aluminum vapor deposition layer is preferably provided on the PTP covering material film in order to satisfy both the requirement of a barrier property and examination of contaminants.

In recent years, printing onto both sides may be required from the viewpoint of medical malpractice. In such cases, an aluminum vapor deposition layer should preferably be provided in consideration of the importance of hiding property (hiding characters or drawings so that they cannot be seen through either side).

The thickness of the aluminum vapor deposition layer may be appropriately adjusted according to the required barrier property (especially water vapor permeability) or near infrared ray reflectance property or hiding property in the case of printing on both sides, but in consideration of the barrier property, the thickness is preferably 10-500 nm, more preferably 20-100 nm. No correspondingly higher gas barrier property effect is obtained even if the thickness is increased above 500 nm. From the viewpoint of near infrared ray reflectance property or hiding property in case of printing on the both sides, the preferred thickness is 10-200 nm and more preferably 20-100 nm. When conducting a translucent half vapor deposition treatment from the viewpoint of a design property, the thickness is preferably 1-50 nm, more preferably 3-20 nm. In regards to the problem of disposal as the object of the invention, separation of the aluminum vapor deposition layer is physically difficult to accomplish, but the thickness of the aluminum layer is significantly reduced compared to conventional aluminum foil covering materials that have thicknesses of about 20 μm (reduction of 97% or more), and therefore the risk of damage to incinerators during thermal disposal is minimal.

EXAMPLES

The invention will now be explained in greater detail by examples and comparative examples. However, the invention is not limited to these examples.

[Evaluated Properties]

The following properties were evaluated for the covering material films fabricated in the examples and comparative examples, and PTP packages employing them.

<Piercing Strength>

Following the procedure of JIS Z1707, the film was pierced with a semicircular needle with a diameter of 1 mm and a tip radius of 0.5 mm, at a speed of 50 mm/min, and the maximum stress to penetration of the needle was measured.

<Orientation Release Stress (ORS)>

Following the procedure of ASTM D-1504, the orientation release stress (peak) value was measured in an oil bath adjusted to a temperature 20° C. higher than the Vicat softening temperature of the thermoplastic resin (or the composition, for multiple thermoplastic resins) used in the covering material film. The measuring directions were the machine direction (MD) and the transverse direction (TD).

<Press-Through Property>

The tearing ease of the covering material film when pushing the tablet from the PTP package was evaluated by touch (sensory evaluation). The judgment criteria were as follows.

A: Similar feel to a conventional aluminum foil covering material, suitable for practical use.

B: Slight resistance during pushing, but no problem for practical use.

C: Film resistant to tearing, difficult to push out. Somewhat inferior suitability for practical use.

D: Film very difficult to tear, very difficult to push out. Judged as unsuitable for practical use.

<Printing Clarity>

The covering material film was printed with black Gothic type alphabet characters with a character size of 7 point, using a gravure printer employing a block having 175 lines/inch and a block depth of 24 μm, and the ease of readability was evaluated. The judgment criteria were as follows.

A: Clear printing, sufficiently readable.

B: Some thin spots or rough edges of characters, but readable without practical problems.

C: Thin spots or rough edges of characters but barely readable, and somewhat inferior suitability for practical use.

D: Severe character thin spots preventing or interfering with reading, and therefore judged to be unsuitable for practical use.

<Tablet Removal Sound, Tablet Removal Sound Volume>

The base material side of the PTP package was pressed with the thumb, in a quiet room with a noise level of ≤40 dB with a distance of 60 cm from the ear of the user to the PTP package, the tablet was pushed out to tear the covering material film, and the sound upon opening was auditorily evaluated.

A: Clear, loud "pop" sound which was very satisfactory.

B: Clear "pop" sound which was satisfactory.

C: Dull sound, no different from a conventional aluminum foil covering material.

A tablet was pushed out in the same manner as above, at a distance of 5 cm from a digital noise meter SL-1320 sound-concentrating microphone by Custom Co., Ltd. to the PIT package, and the maximum measured value with the noise meter was recorded as the tablet removal sound volume. The measuring conditions with the noise meter were Mode: Fast, Characteristic: A, Range: Auto. Measurement was conducted 10 times and the average value was used.

For the evaluation, the pocket size of the base material sheet of the molded PTP was a circular shape with a diameter of 10 mm and a height of 5 mm, and the size of the tablet was a circular shape with a diameter of 8.6 mm and a height of 3.8 mm (filling factor of tablet in pocket: 56%).

[Fabrication of PTP Package]

The following materials were used in the examples and comparative examples.

(1) Styrene-based resin (i) Styrene/methacrylic acid copolymer: SMAA-1 (methacrylic acid content: 13 wt %, Vicat softening temperature=128° C.)

(ii) Styrene/methyl methacrylate/methacrylic acid terpolymer: SMAA-2 (methyl methacrylate content: 5 wt %, methacrylic acid content: 10 wt %, Vicat softening temperature=123° C.)

(iii) High impact polystyrene: HIPS-1 (high-impact polystyrene HT478 by PS Japan Corp., Vicat softening temperature=96° C.)

(iv) High impact polystyrene: HIPS-2 (high-impact polystyrene SX100 by PS Japan Corp., Vicat softening temperature=85° C.)

(v) High impact polystyrene: HIPS-3 (high-impact polystyrene GH8300-5 by DIC Co., Ltd., Vicat softening temperature=95° C.)

(vi) Styrene/acrylic acid copolymer: SAA-1 (Vicat softening temperature=126° C.)

(vii) Styrene-maleic anhydride copolymer: SMA-1 (Vicat softening temperature=83° C.)

(viii) Polystyrene: GPPS-1 (Polystyrene #685 by PS Japan Corp., Vicat softening temperature=103° C.)

(ix) High impact polystyrene: HIPS-4 (high-impact polystyrene 492 by PS Japan Corp., Vicat softening temperature=91° C.)

(2) Amorphous sodium/calcium aluminosilicate (trade name: SILTON JC, by Mizusawa Industrial Chemicals, Ltd.)

(3) Silica (Microid, product of Tokai Chemical Industry Co., Ltd.)

Example 1

Using SMAA-1, HIPS-1 and HIPS-2 as styrene-based resins, they were combined in the proportions indicated for Example 1 in Table 1, and a biaxial stretched film was formed by the inflation method. Next, the obtained film was subjected to 50 mN/m corona treatment, and then a gravure printer was used to print the alphabet characters mentioned above, which were coated with OP varnish. The side opposite the printed side was subjected to 50 mN/m corona treatment in the same manner, after which an ethylene/vinyl acetate-based emulsion-type heat sealing agent was coated to a thickness of about 7 g/m$^2$ as the dry film, to prepare a PTP covering material film. Next, using a 200 μm-thick polyvinyl chloride (PVC) sheet as the base material sheet, tablets were packed into the base material having recesses formed therein using a PTP molding machine (FBP-M1 by CKD Corp.), and each PTP covering material film was attached to obtain a PTP package. The pocket size of the base material sheet was a circular shape with a diameter of 10 mm and a height of 5 mm, and the tablet size was a circular shape with a tablet diameter of 8.6 mm and a tablet height of 3.8 mm (filling factor of tablet in pocket: 56%).

Example 2

A biaxial stretched film was fabricated in the same manner as Example 1, except that SMAA-2 and HIPS-3 were used as styrene-based resins in the mixing proportion indicated for Example 2 in Table 1, and a PTP covering material film was otherwise fabricated in the same manner to obtain a PTP package.

<Evaluation of Examples 1 and 2>

The PTP packages of Examples 1 and 2 were fabricated using covering material films containing no inorganic filler, but stable heat sealing without deformation such as wrinkling in the covering material film was possible during heat sealing with the base material, and the packaging suitability was excellent. The fabricated PTP packages also had a highly satisfactory press-through property and printing clarity.

The tablet removal sound was also highly satisfactory as a clear, loud "pop" sound. The tablet removal sound volume was 61.7 dB in Example 1 and 61.5 dB in Example 2.

The tablet removal sound of widely-used aluminum foil covering materials (film thickness: 20 μm) is a dull sound, and the tablet removal sound volume is a low value of 57.8 dB, and therefore the auditory opening-confirmation effect is inferior to that of Examples 1 and 2.

Example 3

A PTP package was fabricated in the same manner as Example 1, except that silica was added as an inorganic filler and the biaxial stretched film was formed with an approximately 30% greater area draw ratio (thickness: 15 μm), and used as the covering material.

Example 4

A PTP package was fabricated in the same manner as Example 2, except that the biaxial stretched film was formed comprising an amorphous aluminosilicate as an inorganic filler (thickness: 20 μm), and used as the covering material.

<Evaluation of Examples 3 and 4>

Example 3 had addition of a small amount of silica as an inorganic filler, and although a slight degree of roughness was noted on the surface, the press-through property was satisfactory and the printing clarity was also satisfactory, with no problems for practical use. Also, although Example 4 had a small amount of amorphous aluminosilicate also added as an inorganic filler, the press-through property was even smoother than Example 2, and the printing clarity was satisfactory.

Comparative Example 1

A cast film (non-stretched film) with a thickness of 20 μm was fabricated with a T-die method using the same composition as Example 2, and it was attempted to fabricate a PTP package otherwise in the same manner as Example 1, but the film had numerous tears during the printing step and could not proceed to the subsequent steps.

Example 5

A biaxial stretched film with a 14 μm thickness was obtained by the inflation method, in the same manner as Example 1, using a 2-type, 3-layer multilayer die, situating the composition of Example 2 (Vicat softening temperature: 120° C.) as the core layer, and a resin composition with 90 parts by weight of GPPS-1 and 10 parts by weight of HIPS-4 as both outer layers, for a thickness ratio (outer layer/core layer/outer layer) of 10/80/10. The ORS (MD/TD) of the obtained film at 140° C. was 0.29/028 (MPa). The piercing strength was 2.0N. This film was used to fabricate a PTP package in the same manner as Example 1.

<Evaluation of Example 5>

The PTP package of Example 5 employed a covering material film composed of a multilayer stretched film, but it had excellent stability in the PTP packaging step and particularly excellent printing clarity, while the press-through property was such that virtually no uncomfortable feel was noted compared to conventional aluminum covering materials, and the processing suitability and usefulness as a PTP package were highly superior.

TABLE 1

| | | Example 1 | Example 2 | Example 3 | Example 4 | Example 5 | Comp. Ex. 1 |
|---|---|---|---|---|---|---|---|
| Styrene-based resin | SMAA-1 (parts by wt.) | 80 | — | 80 | — | Multilayer film | — |
| | SMAA-2 (parts by wt.) | — | 90 | — | 90 | (see text) | 90 |
| | HIPS-1 (parts by wt.) | 10 | — | 10 | — | | — |
| | HIPS-2 (parts by wt.) | 10 | — | 10 | — | | — |
| | HIPS-3 (parts by wt.) | — | 10 | — | 10 | | 10 |
| | Vicat softening point of resin composition (° C.) | 121 | 120 | 121 | 120 | | 120 |
| Inorganic filler | Amorphous alumina silicate (parts by wt.) | — | — | — | 1.2 | | — |
| | Silica (parts by wt.) | — | — | 1.2 | — | | — |
| | Mean particle size (μm) | — | — | 7.0 | 3.0 | | — |
| Stretching method | | Inflation | Inflation | Inflation | Inflation | Inflation | Unstretched |
| Film thickness (μm) | | 20 | 20 | 15 | 20 | 14 | 20 |
| Piercing strength (N) | | 3.1 | 1.9 | 2.2 | 1.5 | 2.0 | 0.9 |
| ORS (MD/TD) (MPa) | | 0.61/0.37 | 0.34/0.32 | 1.0/0.64 | 0.32/0.31 | 0.29/0.28 | 0.08/0.05 |
| ORS ratio for MD and TD | | 1.65 | 1.06 | 1.56 | 1.03 | 1.04 | 1.60 |
| Press-through property | | A | A | A | A | B | Not evaluatable |
| Printing clarify | | A | A | B | A | A | Not evaluatable |
| Tablet removal sound | | A | A | A | A | A | Not evaluatable |
| Tablet removal sound volume (dB) | | 61.7 | 61.5 | 61.4 | 62.0 | 61.9 | Not evaluatable |

Examples 6-14, 18 and 19

Stretched films were fabricated in the same manner as Example 2, except for using the stretching methods listed in Table 2, and PTP covering material films were otherwise fabricated in the same manner to obtain PTP packages.

Examples 20

Stretched films were fabricated in the same manner as Example 18, except for using the resin mixing proportion listed in Table 2, and PTP covering material films were otherwise fabricated in the same manner to obtain PTP packages.

<Evaluation of Examples 6-14, 18-20>

The PTP packages of Examples 6-14, 18-20 were fabricated using covering material films containing no inorganic filler, by the stretching methods listed in Table 2, and stable heat sealing without deformation such as wrinkling in each covering material film was possible during heat sealing with the base material, and the packaging suitability was excellent. The fabricated PTP packages also had a satisfactory press-through property and printing clarity. The results are shown in Table 2. Particularly from the viewpoint of the press-through property, it is seen that the ORS is preferably 0.2-4.0 MPa, more preferably 0.3-3.0 MPa and even more preferably 0.3-2.0 MPa, for both the MD and TD. In addition, the results showed that from the viewpoint of both the press-through property and the tablet removal sound, the ORS ratio is preferably 0.2-15 and more preferably 0.5-2.0 for the MD and TD.

Examples 15-17

Stretched films were fabricated in the same manner as Example 2, except for using the resin mixing proportions and stretching methods listed in Table 2, and PTP covering material films were otherwise fabricated in the same manner to obtain PTP packages.

<Evaluation of Example 15>

The PTP package of Example 15 employed a covering material film containing HIPS as the resin composition, and although the stability during stretching film formation was sometimes found to be slightly unstable, the press-through property and printing clarity were both satisfactory. The results are shown in Table 2.

<Evaluation of Example 16>

Example 16 employed SAA as a styrene-based resin, and although a slight degree of roughness was noted on the surface, the press-through property was satisfactory and the printing clarity was also satisfactory, with no problems for practical use.

<Evaluation of Example 17>

Example 17 employed SMA as a styrene-based resin, and although a small number of wrinkles were generated during heat sealing to the base material with the PTP molding machine, and roughness was noted on the surface, the press-through property was satisfactory and the printing clarity was also satisfactory, with no problems for practical use.

toward a slightly lower press-through property but were suitable for practical use, and the printing clarity and tablet removal sound were both satisfactory. The results are shown in Table 3.

Comparative Example 2

GPPS-1, HIPS-4 and amorphous aluminosilicate were combined in the proportions listed in Table 3, and a cast film was produced by the T-die method, without applying stretching. A PTP package was fabricated in the same manner as Example 1, except that the film obtained in this manner was used as the covering material.

<Evaluation of Comparative Example 2>

The PTP package of Comparative Example 2 was fabricated using a film formed with virtually no stretching, as the covering material. Due to the lack of stretching, the fabricated film had low strength, and tearing occurred upon take-up during the film formation. It was also attempted to print onto the film that had just been obtained, but it tore making it impossible to accomplish printing.

TABLE 2

| | Example 6 | Example 7 | Example 8 | Example 9 | Example 10 | Example 11 | Example 12 | Example 13 | Example 14 |
|---|---|---|---|---|---|---|---|---|---|
| Resin and filler contents (parts by wt.) and filler mean particle size (μm) | Same as Example 2 | | | | | | | | |
| Vicat softening point of resin composition (° C.) | Same as Example 2 | | | | | | | | |
| Stretching method | Tenter | | Roll | Tenter | | | Tenter | | Roll |
| Film thickness (μm) | 20 | 20 | 20 | 20 | 20 | 20 | 20 | 20 | 21 |
| Piercing strength (N) | 3.8 | 3.9 | 4.8 | 2.3 | 2.4 | 4.2 | 6.1 | 7.1 | 6.9 |
| ORS (MD/TD) (MPa) | 1.9/2.0 | 0.7/3.4 | 3.5/0.5 | 0.6/2.1 | 2.3/0.6 | 3.6/3.7 | 0.7/4.9 | 4.8/5.2 | 4.9/0.3 |
| ORS ratio for MD and TD | 0.95 | 0.21 | 7 | 0.29 | 3.83 | 0.97 | 0.14 | 0.92 | 16.3 |
| Press-through property | A | B | B | B | B | B | C | C | C |
| Printing clarify | A | B | B | A | A | B | B | B | C |
| Tablet removal sound | A | B | B | B | B | A | B | A | B |
| Tablet removal sound volume (dB) | 61.6 | 59.6 | 59.8 | 59.8 | 59.5 | 62.1 | 59.7 | 62.5 | 59.7 |

| | Example 15 | Example 16 | Example 17 | Example 18 | Example 19 | Example 20 |
|---|---|---|---|---|---|---|
| Resin and filler contents (parts by wt.) and filler mean particle size (μm) | SMAA-1 = 100 | SAA-1/HIPS-1/HIPS-2 = 80/10/10 | SMA-1/HIPS-1/HIPS-2 = 80/10/10 | Same as Example 2 | | SMAA-1/HIPS-3 = 60/40 |
| Vicat softening point of resin composition (° C.) | 128 | 120 | 85 | Same as Example 2 | | 115 |
| Stretching method | Inflation | Tenter | | | Inflation | |
| Film thickness (μm) | 20 | 20 | 20 | 20 | 25 | 20 |
| Piercing strength (N) | 4.2 | 3.5 | 1.0 | 1.0 | 1.8 | 1.8 |
| ORS (MD/TD) (MPa) | 0.6/0.4 | 1.7/1.9 | 0.3/0.4 | 0.6/0.1 | 0.8/0.1 | 1.0/0.1 |
| ORS ratio for MD and TD | 1.5 | 0.89 | 0.75 | 6.0 | 8.0 | 10.0 |
| Press-through property | A | B | A | B | B | B |
| Printing clarify | A | A | C | A | A | A |
| Tablet removal sound | A | A | B | B | A | A |
| Tablet removal sound volume (dB) | 61.7 | 61.4 | 59.9 | 59.7 | 62.2 | 62.0 |

Examples 21-28

Stretched films were fabricated in the same manner as Example 2, except for using the resin mixing proportions and stretching methods listed in Table 3, and PTP covering material films were otherwise fabricated in the same manner to obtain PTP packages.

<Evaluation of Examples 21-28>

The PTP packages of Examples 21-28 employed polystyrene as the resin composition, and they had a tendency

Comparative Example 3

A PTP package was fabricated in the same manner as Comparative Example 2, except that an unstretched cast film with a different thickness and physical properties was used as the covering material, as shown in Table 3.

<Evaluation of Comparative Example 3>

The PTP package of Comparative Example 3 was fabricated using a film formed with virtually no stretching, similar to Comparative Example 2. Considering the result of film tearing in Comparative Example 2, this film was formed to a greater thickness to withstand the printing and heat sealing agent steps. The inorganic filler content was reduced to 4.5 parts by weight to 100 parts by weight of the styrene resin, and therefore the printing clarity was satisfactory. However, since the PTP package of Comparative Example 3 had high piercing strength of 7.5N and a poor press-through property, it was not suitable for practical use.

Comparative Example 4

A PTP package was fabricated in the same manner as Example 2, except that the biaxial stretched film was formed comprising GPPS-1, and an amorphous aluminosilicate in the contents shown in Table 3, (thickness: 30 μm), and used as the covering material.

<Evaluation of Comparative Example 4>

The PTP package of Comparative Example 4 was fabricated using a biaxial stretched film having an inorganic filler content of 7 parts by weight to 100 parts by weight of the styrene-based resin. Because of the large amount of inorganic filler, the printing clarity was poor.

TABLE 3

| | | Example 21 | Example 22 | Example 23 | Example 24 | Example 25 | Example 26 |
|---|---|---|---|---|---|---|---|
| Styrene-based resin | GPPS-1 (parts by wt.) | 90 | 90 | 90 | 90 | 90 | 90 |
| | HIPS-4 (parts by wt.) | 10 | 10 | 10 | 10 | 10 | 10 |
| | Vicat softening point of resin composition (° C.) | 102 | 102 | 102 | 102 | 102 | 102 |
| Inorganic filler | Amorphous alumina silicate (parts by wt.) | — | — | 1.2 | 1.2 | — | — |
| | Silica (parts by wt.) | — | — | — | — | 1.2 | 4.5 |
| | Mean particle size (μm) | — | — | 3.0 | 4.0 | 7.0 | 3.0 |
| Stretching method | | Inflation | Inflation | Inflation | Inflation | Inflation | Inflation |
| Film thickness (μm) | | 8 | 14 | 14 | 20 | 20 | 30 |
| Piercing strength (N) | | 2.1 | 3.2 | 2.1 | 2.7 | 2.7 | 1.4 |
| ORS (MD/TD) (MPa) | | 2.0/1.3 | 1.8/1.1 | 2.0/1.3 | 1.6/0.7 | 1.6/0.7 | 1.3/0.8 |
| ORS ratio for MD and TD | | 1.54 | 1.64 | 1.54 | 2.29 | 2.29 | 1.63 |
| Press-through property | | B | C | B | B | B | B |
| Printing clarify | | A | A | A | A | B | B |
| Tablet removal sound | | B | B | A | B | B | A |
| Tablet removal sound volume (dB) | | 59.7 | 59.1 | 61.5 | 60.1 | 59.2 | 61.9 |

| | | Example 27 | Example 28 | Comp. Ex. 2 | Comp. Ex. 3 | Comp. Ex. 4 |
|---|---|---|---|---|---|---|
| Styrene-based resin | GPPS-1 (parts by wt.) | 80 | 100 | 80 | 80 | 80 |
| | HIPS-4 (parts by wt.) | 20 | 0 | 20 | 20 | 20 |
| | Vicat softening point of resin composition (° C.) | 101 | 103 | 101 | 101 | 101 |
| Inorganic filler | Amorphous alumina silicate (parts by wt.) | 4.5 | — | 1.2 | — | 7 |
| | Silica (parts by wt.) | — | — | | 4.5 | |
| | Mean particle size (μm) | 3.0 | — | 3.0 | 7.0 | 4.0 |
| Stretching method | | Inflation | Inflation | Unstretched | Unstretched | Inflation |
| Film thickness (μm) | | 25 | 14 | 30 | 100 | 30 |
| Piercing strength (N) | | 2.0 | 3.5 | 1.4 | 7.5 | 1.1 |
| ORS (MD/TD) (MPa) | | 4.8/1.4 | 1.7/1.0 | 0.2/0.1 | 0.1/0.1 | 1.5/0.9 |
| ORS ratio for MD and TD | | 3.43 | 1.70 | 2.00 | 1.00 | 1.67 |
| Press-through property | | B | C | Not evaluatable | D | B |
| Printing clarify | | A | A | Not printable | B | D |
| Tablet removal sound | | B | B | Not evaluatable | Not evaluatable | A |
| Tablet removal sound volume (dB) | | 59.4 | 59.4 | Not evaluatable | Not evaluatable | 61.6 |

The PTP package of the invention can be suitably used primarily for packaging of pharmaceuticals such as tablets or capsules, or foods such as candy or chocolate.

[Explanation of Symbols]

1: Base material, 1*a*: base material recess, 1*b*: base material flange section, 2: tablet, 3: seal layer, 4A, 4B, 4C: covering material films, 41: multilayer covering material film surface layer, 42: multilayer covering material film center layer, 5: printed section, 6: OP varnish layer, 7: vapor deposition layer, 10, 20, 30: packages.

What is claimed is:

1. A press-through pack (PTP) package, comprising:

a base material; and a covering material, wherein the covering material is composed of a stretched film including at least one layer which comprises a styrene-based resin having a styrene-based monomer component of 70-97 wt % and an ester component of 2-20 wt %, and an inorganic filler at less than 5 parts by weight with respect to 100 parts by weight of the styrene-based resin, and wherein the styrene-based resin is at least one terpolymer resin selected from the group consisting of a terpolymer resin consisting of monomer components of styrene-acrylic acid copolymer resins and an ester component, a terpolymer resin consisting of monomer components of styrene-methacrylic acid copolymer resins and an ester component, and a terpolymer resin consisting of monomer components of styrene-maleic anhydride copolymer resins and an ester component.

2. A press-through pack package according to claim 1, wherein the stretched film has a value of 0.2-5.4 MPa for the peak value of the orientation release stress, measured at a temperature 20° C. higher than the Vicat softening temperature of the styrene-based resin, in both the MD and TD of the film.

3. A press-through pack package according to claim 1, wherein the mean particle size of the inorganic filler is 1-10 μm.

4. A press-through pack package according to claim 1, wherein the inorganic filler is an amorphous aluminosilicate.

5. A press-through pack package according to claim 1, wherein the stretched film has a thickness of 5-30 μm.

6. A press-through pack package according to claim 1, wherein the stretched film has an aluminum vapor deposition layer laminated on at least one side.

7. A press-through pack (PTP) package with a covering material composed of a stretched film including at least one layer which comprises a styrene-based resin having a styrene-based monomer component of 70-97 wt % and an ester component of 2-20 wt %, and an inorganic filler at less than 5 parts by weight with respect to 100 parts by weight of the styrene-based resin, wherein the styrene-based resin is at least one terpolymer resin selected from the group consisting of a terpolymer resin consisting of monomer components of styrene-acrylic acid copolymer resins and an ester component, a terpolymer resin consisting of monomer components of styrene-methacrylic acid copolymer resins and an ester component, and a terpolymer resin consisting of monomer components of styrene-maleic anhydride copolymer resins and an ester component, and wherein the stretched film has a piercing strength of 1-5N as measured by a piercing strength test of JIS Z1707.

8. A press-through pack (PTP) package, comprising:

a base material; and a covering material, wherein the covering material is composed of a stretched film including at least one layer which comprises a styrene-based resin having a styrene-based monomer component of 70-97 wt % and an ester component of 2-20 wt % and an inorganic filler at less than 5 parts by weight with respect to 100 parts by weight of the styrene-based resin, wherein the styrene-based resin is at least one terpolymer resin selected from the group consisting of a terpolymer resin consisting of monomer components of styrene-acrylic acid copolymer resins and an ester component, a terpolymer resin consisting of monomer components of styrene-methacrylic acid copolymer resins and an ester component, and a terpolymer resin consisting of monomer components of styrene-maleic anhydride copolymer resins and an ester component, wherein the stretched film has a value of 0.2-5.4 MPa for the peak value of the orientation release stress, measured at a temperature 20° C. higher than the Vicat softening temperature of the styrene-based resin, in either the MD or the TD of the film, and wherein the stretched film has a piercing strength of 1-5 N when measured with a piercing strength measuring jig having a 1.0 mm piercing tip spherical diameter.

9. A press-through pack (PTP) package with a covering material composed of a stretched film including at least one layer which comprises a styrene-based resin having a styrene-based monomer component of 70-97 wt % and an ester component of 2-20 wt %, and an inorganic filler at less than 5 parts by weight with respect to 100 parts by weight of the styrene-based resin, wherein the styrene-based resin is at least one terpolymer resin selected from the group consisting of a terpolymer resin consisting of monomer components of styrene-acrylic acid copolymer resins and an ester component, a terpolymer resin consisting of monomer components of styrene-methacrylic acid copolymer resins and an ester component, and a terpolymer resin consisting of monomer components of styrene-maleic anhydride copolymer resins and an ester component, and wherein the stretched film has a piercing strength of 1-5 N when measured with a piercing strength measuring jig having a 1.0 mm piercing tip spherical diameter.

* * * * *